US008056628B2

(12) United States Patent
Whitsitt et al.

(10) Patent No.: US 8,056,628 B2
(45) Date of Patent: Nov. 15, 2011

(54) SYSTEM AND METHOD FOR FACILITATING DOWNHOLE OPERATIONS

(75) Inventors: John R. Whitsitt, Houston, TX (US); Jason K. Jonas, Missouri City, TX (US); Gary L. Rytlewski, League City, TX (US); Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/626,739

(22) Filed: Jan. 24, 2007

(65) Prior Publication Data

US 2008/0128130 A1 Jun. 5, 2008

Related U.S. Application Data

(63) Continuation-in-part of application No. 11/566,459, filed on Dec. 4, 2006.

(51) Int. Cl.
*E21B 43/04* (2006.01)
*E21B 34/06* (2006.01)

(52) U.S. Cl. ..... 166/278; 166/386; 166/373; 166/51

(58) Field of Classification Search ..... 166/278, 166/386, 250.07, 51, 65.1, 66.6, 373, 374, 166/332.1, 332.2, 332.7, 316, 319, 324, 334.1, 166/334.2, 334.4, 142, 152
See application file for complete search history.

(56) References Cited

U.S. PATENT DOCUMENTS

| | | | | |
|---|---|---|---|---|
| 2,340,481 | A * | 2/1944 | Lloyd | 166/74 |
| 3,439,740 | A * | 4/1969 | Conover | 166/250.07 |
| 5,174,379 | A | 12/1992 | Whiteley | |
| 5,377,750 | A * | 1/1995 | Arterbury et al. | 166/205 |
| 5,636,691 | A | 6/1997 | Hendrickson | |
| 5,875,852 | A * | 3/1999 | Floyd et al. | 166/387 |
| 6,148,915 | A | 11/2000 | Mullen | |
| 6,216,785 | B1 | 4/2001 | Achee, Jr. et al. | |
| 6,230,801 | B1 | 5/2001 | Hill, Jr. et al. | |
| 6,343,651 | B1 * | 2/2002 | Bixenman | 166/278 |
| 6,371,210 | B1 * | 4/2002 | Bode et al. | 166/370 |
| 6,446,729 | B1 | 9/2002 | Bixenman | |
| 6,488,082 | B2 * | 12/2002 | Echols et al. | 166/51 |
| 6,622,794 | B2 * | 9/2003 | Zisk, Jr. | 166/373 |
| 6,702,020 | B2 | 3/2004 | Zachman | |
| 6,719,064 | B2 * | 4/2004 | Price-Smith et al. | 166/387 |

(Continued)

FOREIGN PATENT DOCUMENTS

WO 0005484 A1 2/2000

(Continued)

OTHER PUBLICATIONS

Integrated Perforating and Gravel Packing Speeds Completions, Case Study: PERFPAC Service Reduces Formation Damage, Saves Rig Time in West African Deepwater Play. 06-WT-084, Aug. 2006.

(Continued)

*Primary Examiner* — Kenneth L Thompson
(74) *Attorney, Agent, or Firm* — Robert Van Someren; David G. Matthews; Rodney Warfford

(57) ABSTRACT

A technique is provided to facilitate use of a service tool at a downhole location. The service tool has different operational configurations that can be selected and used without moving the service string.

34 Claims, 7 Drawing Sheets

U.S. PATENT DOCUMENTS

| | | | | |
|---|---|---|---|---|
| 6,749,023 | B2 | 6/2004 | Nguyen et al. | |
| 6,766,857 | B2 | 7/2004 | Bixenman | |
| 6,782,948 | B2 | 8/2004 | Echols | |
| 6,786,285 | B2 * | 9/2004 | Johnson et al. | 166/370 |
| 6,886,634 | B2 * | 5/2005 | Richards | 166/278 |
| 6,899,176 | B2 | 5/2005 | Hailey | |
| 6,978,840 | B2 * | 12/2005 | Henderson | 166/380 |
| 6,983,796 | B2 * | 1/2006 | Bayne et al. | 166/278 |
| 7,017,664 | B2 | 3/2006 | Walker et al. | |
| 7,055,598 | B2 * | 6/2006 | Ross et al. | 166/236 |
| 7,100,690 | B2 | 9/2006 | Mullen | |
| 7,124,824 | B2 | 10/2006 | Turner et al. | |
| 7,128,151 | B2 | 10/2006 | Corbett | |
| 7,210,527 | B2 | 5/2007 | Walker | |
| 7,237,616 | B2 | 7/2007 | Patel | |
| 7,252,152 | B2 | 8/2007 | LoGiudice | |
| 7,331,388 | B2 | 2/2008 | Vilela | |
| 7,367,395 | B2 | 5/2008 | Vidrine | |
| 7,383,884 | B1 | 6/2008 | Turner | |
| 7,472,750 | B2 | 1/2009 | Walker | |
| 2002/0070019 | A1 * | 6/2002 | Dusterhoft et al. | 166/285 |
| 2004/0094304 | A1 | 5/2004 | Turner et al. | |
| 2006/0090900 | A1 * | 5/2006 | Mullen et al. | 166/376 |
| 2006/0113089 | A1 * | 6/2006 | Henriksen et al. | 166/386 |

FOREIGN PATENT DOCUMENTS

| | | |
|---|---|---|
| WO | 0165063 | 9/2001 |
| WO | WO 03023185 A1 * | 3/2003 |

OTHER PUBLICATIONS

Schlumberger PERFPAC webpage.

Quantum PERFPAC Single-Trip System; SC_03_044_0, Jan. 2004.

PERFPAC Image.

* cited by examiner

SYSTEM AND METHOD FOR FACILITATING DOWNHOLE OPERATIONS

CROSS REFERENCE TO RELATED APPLICATION

This application is a continuation-in-part of U.S. application Ser. No. 11/566,459 filed Dec. 4, 2006.

BACKGROUND

In a variety of well completion operations, a sandface assembly, including screens, is conveyed by a service tool and positioned across a hydrocarbon bearing formation. Upon placement of the sandface assembly, numerous well operations, such as placing a gravel pack in the annulus between the Earth formation and the screens, are performed. Successful completion of these operations typically requires numerous movements of the service tool relative to the sandface assembly to effectuate a variety of flow paths.

For successful execution of a service job, a detailed understanding of the downhole interactions between the service tool/service string and the sandface assembly is required Specific downhole service tools are actuated by movement of the service string which requires an operator to have substantial knowledge of the downhole service tool as well as an ability to visualize the operation and status of the service tool. Typically, the operator marks the service string at a surface location to track the relative positions of the service tool and the downhole sandface assembly. As the service string is moved, each marked position is assumed to indicate a specific position of the service tool relative to the downhole sandface assembly. This approach, however, relies on substantial knowledge and experience of the operator and is susceptible to inaccuracies due to, for example, extension and contraction of the service string. Moreover, in highly deviated wellbores with difficult trajectories, much of the string movement is lost between the surface and the downhole location due to string buckling, compression, and the like. In such systems where gravel packs are performed, the service tool also can be prone to sticking with respect to the downhole sandface assembly.

SUMMARY

In general, the present invention provides a technique for facilitating the use of service tools at downhole locations. The approach utilizes a substantially non-moving service tool. While remaining stationary, the flow paths within the service tool can be repositioned from one operational mode to another to carry out a variety of service procedures at a downhole location.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for facilitating the operation of a service string in a downhole environment. The service string comprises a service tool that may be moved downhole into a wellbore to a desired formation location. The service tool is used in conjunction with other downhole well equipment, such as a sandface assembly. The service tool may be moved through several operational modes without physically sliding the service tool relative to the sandface assembly, i.e. without lineal movement of the service tool within the sandface assembly otherwise caused by movement of the service string.

Figure 1:
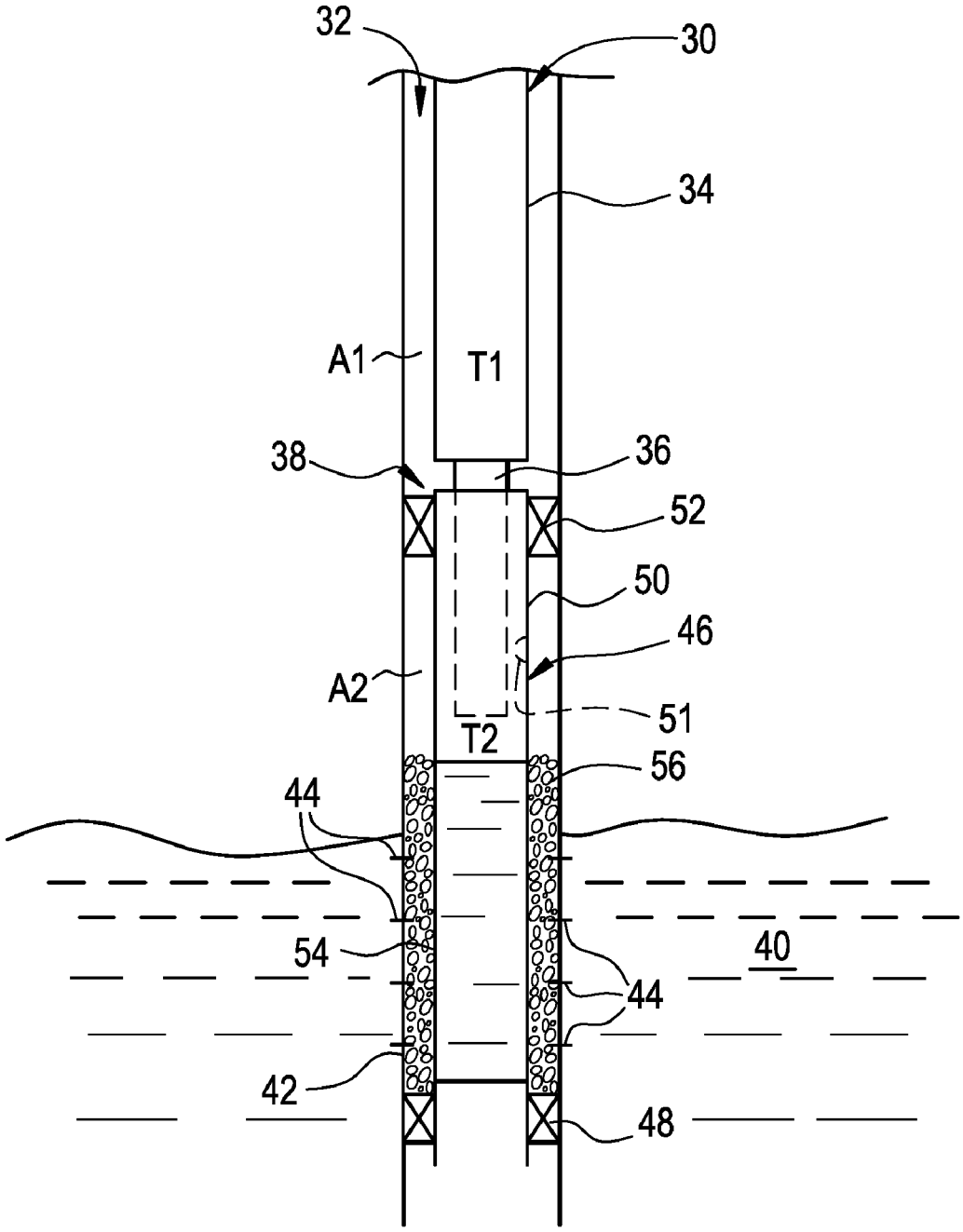
FIG. 1 is a schematic view of an embodiment of a service string deployed in a wellbore, according to an embodiment of the present invention.

Referring generally to FIG. 1, an embodiment of a well system 30 is illustrated as installed in a wellbore 32. In this embodiment, well system 30 comprises a service string 34 having a service tool 36. The service tool 36 can be moved downhole into wellbore 32 for interaction with downhole equipment 38, such as a sandface assembly. In many applications, the service string and the sandface assembly are coupled together at the surface and conveyed downhole as a single unit. After reaching the desired depth and undergoing preliminary operations, the service string is decoupled from the sandface assembly.

The wellbore 32 can be vertical or deviated depending on the type of well application and/or well environment in which service string 34 is used. Generally, wellbore 32 is drilled into a geological formation 40 containing desirable production fluids, such as petroleum. In at least some applications, wellbore 32 is lined with a wellbore casing 42. A plurality of perforations 44 is formed through wellbore casing 42 to enable flow of fluids between the surrounding formation 40 and the wellbore 32. Alternatively, the wellbore may be unlined. In this latter case, the top end of the sandface assembly is positioned in the lower end of the casing before the open hole section begins.

In the embodiment illustrated, sandface assembly 38 comprises a bottom hole assembly 46. In some applications, the bottom hole assembly 46 extends into cooperation with a lower packer 48, installed on a previous trip downhole. In other applications, e.g. open hole applications, the lower packer 48 is not necessary. The bottom hole assembly 46 has a receptacle structure 50 into which service tool 36 of service string 34 is inserted for the performance of various procedures. In one example of bottom hole assembly 46, the receptacle structure 50 comprises a circulation housing having one or more ports 51 through which gravel is placed via the service tool. In this embodiment, the circulation housing also may include a closing sleeve (not shown) which is closed after the process of gravel deposition is completed. The bottom hole assembly 46 also comprises a gravel packing (GP) packer 52 positioned between receptacle structure 50 and the wall of wellbore 32. The circulation housing and gravel packing packer 52 effectively provide the receptacle that works in cooperation with service string 34. By way of example, cooperative features may include a mechanical attachment at the top of packer 52 for receiving the service tool, and polish bores can be located above and below circulation port 51 to ensure gravel deposition is directed only through port 51. The bottom hole assembly 46 further comprises a screen assembly 54 that may be formed of one or more individual screens. In some applications, service string 34, service tool 36 and bottom hole assembly 46 are used in cooperation to carry out a gravel packing operation in which a gravel pack 56 is placed in the region of wellbore 32 generally surrounding screen 54.

Service tool 36 and sandface assembly 38 can be used to carry out a variety of procedures during a given operation, such as a gravel packing operation. Additionally, well system 30 may be switched between many procedures without movement of service string 34. In other words, the service string 34 and service tool 36 "sit still" relative to bottom hole assembly 46 instead of continuously being "pulled up" or "slacked off" to cause changes from one procedure to another.

Figure 2:
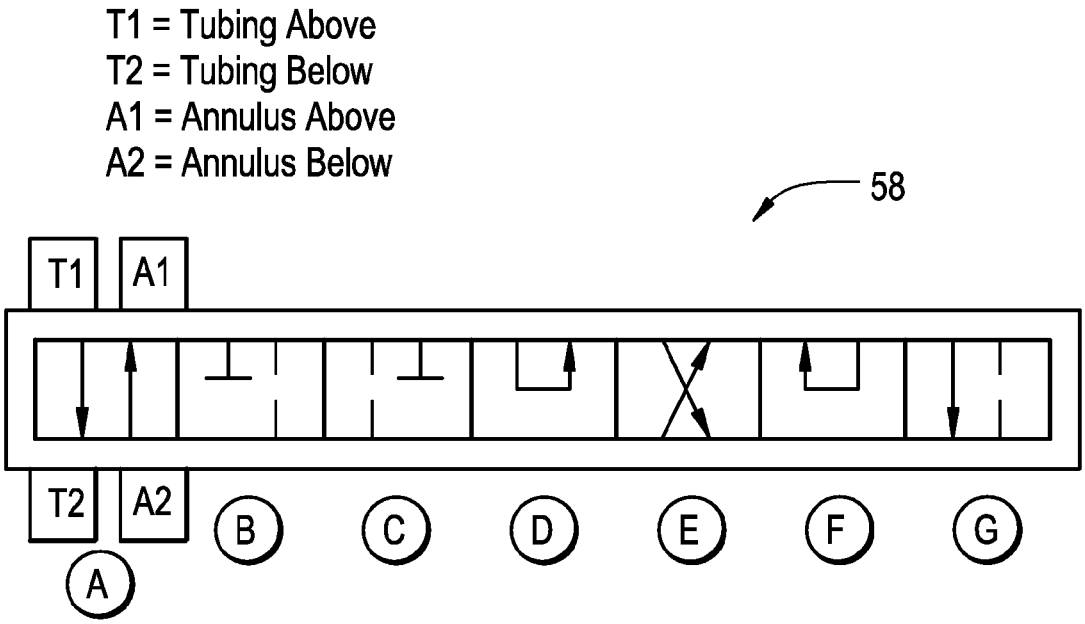
FIG. 2 is schematic illustration of valve positions for different operating modes of a service tool, according to an embodiment of the present invention.

As illustrated schematically in FIG. 2, the service tool 36 and bottom hole assembly 46 rely on a valve system 58 to achieve desired operating modes without movement, i.e. lifting or settling, of the service tool 36 inside GP packer 52. By way of example, valve system 58 can be used in any of the operating modes A-G during a gravel packing operation. The valve system operating modes control the flow of fluids between various wellbore regions, such as the tubing above GP packer 52 (T1), the tubing below GP packer 52 (T2), the annulus above GP packer 52 (A1), and the annulus below GP packer 52 (A2). (See also FIG. 1).

For example, during running-in-hole of service string 34 to perform a gravel packing operation, valve system 58 is placed in configuration A which enables the open flow of fluid from T1 to T2 and from A2 to A1 during movement downhole. Once at the desired wellbore position, the setting of packer 52 is achieved by actuating valve system 58 to configuration B in which fluid flow is blocked between T1 and T2. After setting packer 52, an annulus test can be performed by actuating valve system 58 to configuration C in which flow between A1 and A2 is blocked. An operational mode for spotting fluids prior to the gravel pack is achieved by actuating valve system 58 to configuration D in which fluids may be flowed down the service string at T1 and returned via the annulus at A1.

In this example, the actual gravel packing is initiated by actuating valve system 58 to configuration E which allows the gravel slurry to flow from T1 to A2 to form gravel pack 56 along the exterior of screen 54. The carrier fluid then flows to T2 and is directed out of the service tool 36 to the annulus at A1 for return to the surface. Subsequently, valve system 58 may be placed in a reversing configuration which is illustrated as configuration F. In this configuration, fluid may be flowed down through A1 and returned via the service string tubing at T1. Valve system 58 also may be adjusted to a breaker configuration G that facilitates the breaking or removal of filter cake when service tool 36 is removed from wellbore 32. By removing the need to physically move the service string 34 to adjust the valve configurations, premature breakage of the filter cake is avoided.

The valve system 58 may be actuated between many operational configurations with no movement of service string 34 relative to packer 52. Other changes between operational configurations only require a simple "pull up" input or a "slack off" input to cause a slight movement above GP packer 52 rather than moving service tool 36 within receptacle structure 50. The ability to easily change from one valve system configuration to another with no or minimal movement of the service string provides a much greater degree of functionality with respect to the operation of the well system. For example, the sequential valve configuration changes from configuration B to configuration D can be repeated or reversed. Additionally, the circulating configuration E and the reversing configuration F are readily reversible and can be repeated. Accordingly, valve system 58 provides great functionality to achieve a desired well operation, e.g. gravel packing operation, without being susceptible to sticking problems and without requiring the operational finesse of conventional systems.

Figure 3:
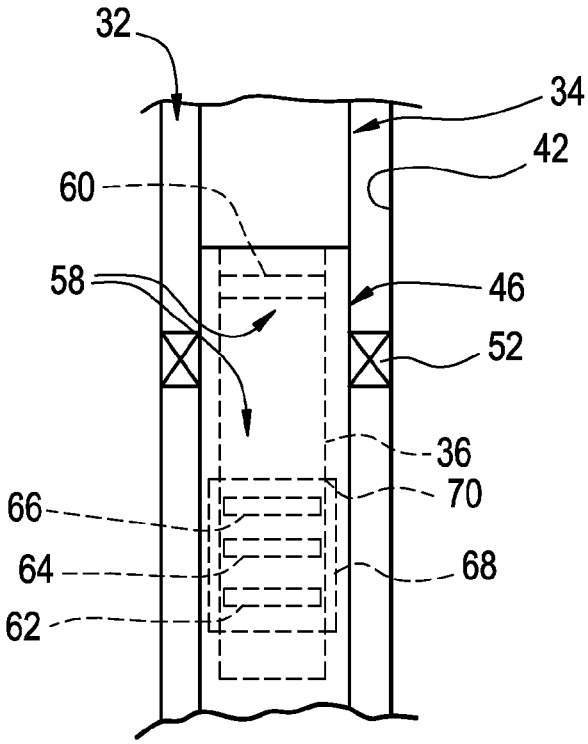
FIG. 3 is a schematic illustration of an embodiment of a valve system used in the service tool, according to an embodiment of the present invention.

Referring generally to FIG. 3, a schematic illustration of one embodiment of valve system 58 is illustrated. In this embodiment, valve system 58 comprises, for example, a sleeve valve 60, a lower tubing valve 62, an upper tubing valve 64, and a sleeve valve 66. Lower tubing valve 62 and upper tubing valve 64 may be designed as ball valves, however other types of valves also may be used. Additionally, valves 62, 64 and 66 may be arranged as a plurality of valves with each of the individual valves controlled by a valve control system 68 able to individually actuate the valves 62, 64 and 66 between specific operational configurations without movement of service string 34 relative to packer 52.

Control signals can be sent to valve control system 68 via, for example, pressure signals, pressure signals on the annulus, load, e.g. tensile, signals, flow rate signals, other wireless communication signals sent downhole, and electromagnetic signals. In one embodiment, valve control system 68 receives pressure signals sent via the annulus surrounding service string 34 and appropriately actuates one or more of the individual valves 62, 64 and/or 66 in response to the pressure signal. In this example, annular valve 60 is used to control flow between the annulus and the service string and is actuated between open and closed positions with string weight. For example, the service string 34 may be pulled up, i.e. placed in tension for specific command sequences, and the string weight may be slacked-off, i.e. placed under a set down load, for circulation operations. Alternatively, the valve may be designed to open and allow circulation operations when the service string is placed under tension and to close for command sequences when weight is slacked off. Valves 60, 62, 64 and 66 can be individually actuated to achieve any of the valve configurations A-G, for example, illustrated in FIG. 2. Valve control system 68 also may comprise an uplink telemetry system 70 able to output signals, e.g. electrical signals, optical signals, wireless signals, etc., to the surface to confirm the positions of individual valves.

Figure 4:
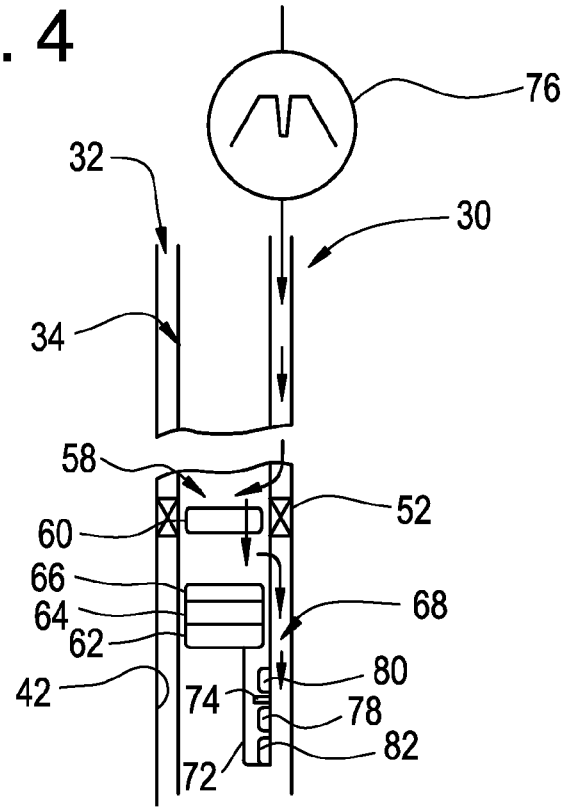
FIG. 4 is a schematic illustration of a service tool with a control system for controlling valve positioning in the service tool, according to an embodiment of the present invention.

Although other types of valve control systems 68 can be implemented, one example uses an intelligent remote implementation system (IRIS) control technology available from Schlumberger Corporation. An IRIS based control system 68 is able to recognize signatures in the form of, for example, pressure signatures, flow rate signatures or tensile signatures. As illustrated in FIG. 4, one embodiment of an IRIS based control system 68 comprises a control module 72 having a pressure sensor 74 positioned to sense low-pressure, pressure pulse signatures, e.g. pressure pulse signature 76 illustrated in FIG. 4. The pressure sensor 74 is coupled to control electronics 78 having a microprocessor which decodes the pressure pulse signature. The microprocessor compares a given pressure pulse signature against commands in a tool library. If a match is found, the control electronics 78 outputs an appropriate signal to an actuator 80 which opens and/or closes the appropriate valve. In this embodiment, actuator 80 comprises hydrostatic and atmospheric chambers that enable hydraulic control over each valve, e.g. valve 60, 62 or 64, by alternating operating pressure between hydrostatic and atmospheric as in available IRIS control systems. Power is supplied to control electronics 78 and actuator 80 via a battery 82.

With control systems, such as the IRIS based control system available from Schlumberger Corporation, an over-ride can be used to disable electronics 78 and to move the valves to a standard gravel packing operational position. In this embodiment, a high pressure, e.g. approximately 4000 psi, is applied through the annulus to over-ride control 72. For example, control 72 may be provided with a rupture disc (not shown) that ruptures upon sufficient annulus pressure to enable manipulation of service tool 36 to a default position via the pressurized annulus fluid. By way of example, the over-ride may be designed to release service tool 36 from packer 52 while opening lower valve 62, opening port body valve 66, and closing upper valve 64. The service tool 36 can then be operated in this standard service tool configuration.

Figure 5:
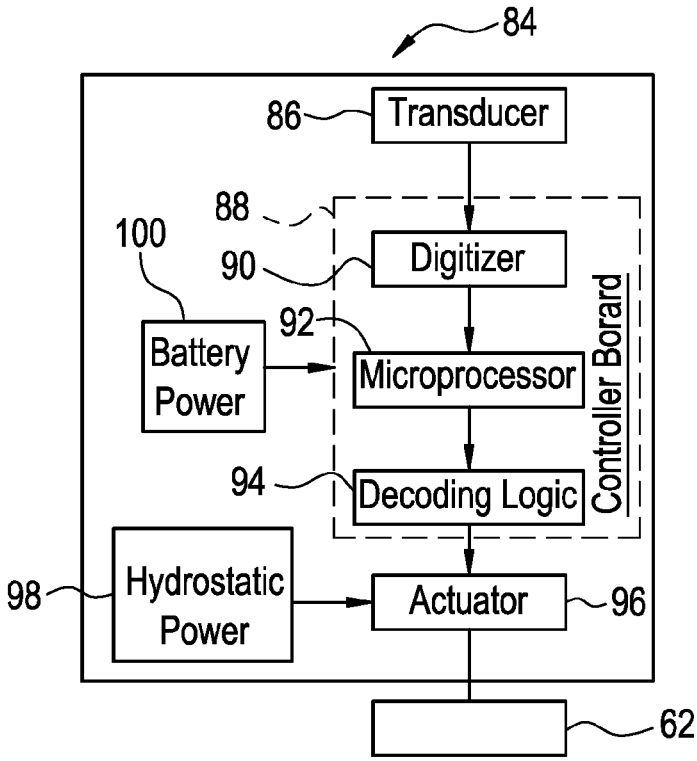
FIG. 5 is a schematic illustration of an embodiment of a steady state control system combined with a valve that can be used in the service tool, according to an embodiment of the present invention.
Figure 6:
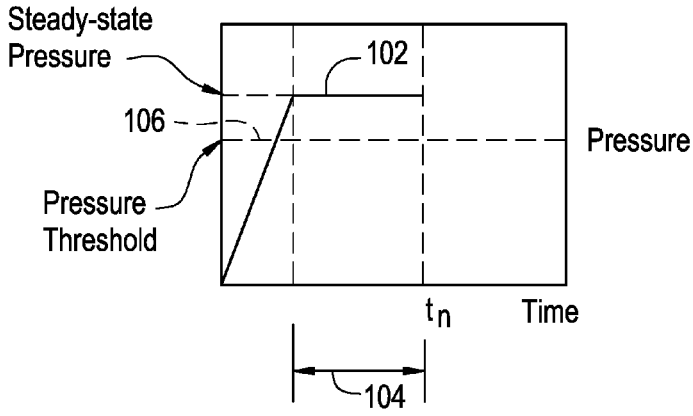
FIG. 6 is a graphical representation of steady-state pressure achieved above a pressure threshold to activate the valve illustrated in FIG. 5, according to an embodiment of the present invention.

Other methods and mechanisms also can be used to control one or more of the valves of valve system 58. For example, lower valve 62 can be designed to be responsive to a ball passing through an obstruction in a proximate bore. The obstruction can be a collet device that flexes as the ball passes through. The control senses the flexing and causes lower valve actuation. The ball that passes through the flexing collet can be dissolvable such that it presents no obstruction after performing its primary function. In this embodiment, flow is again enabled when the ball is dissolved. Lower valve 62 also can be designed as a ball valve responsive to a predetermined fluid flow. For example, fluid flow through a venturi can be used to create a pressure drop that is used directly or in conjunction with an appropriate electronic actuator to actuate valve 62 to a desired position, e.g. a closed position. The flow activated control approach also can be used as a backup for a control system, such as the control system described with reference to FIG. 4. In another embodiment, valve 62 is a ball valve controlled by a control device 84, such as the device schematically illustrated in FIG. 5. Control device 84 can be designed to respond to, for example, steady state sensing, flow signatures, and/or a dissolvable ball flexing an obstruction in a proximate bore, as well as other inputs. As illustrated in FIG. 6, one example of control device 84 is designed to respond to a steady-state condition sensed in the wellbore. Another method to control lower valve 62 is to make the valve responsive to a predetermined flow signature.

In this latter embodiment, the first actuation of lower ball valve 62 or other downhole device is performed in response to the sensing of a steady-state condition. The steady-state condition is detected by, for example, unchanging magnitudes of pressure and/or temperature. For example, control device 84 can be designed to actuate when pressure P satisfies the steady state condition at time $t_n$. Satisfaction of the steady-state condition requires that: $P(t_n)-P(t_{n-1})\sim 0$; $P(t_{n-1})-P(t_{n-2})\sim 0$; etc. for t=the predetermined number of times samples. The same approach can be used for determining a steady-state temperature condition necessary for actuation of valve 62.

As illustrated graphically in FIG. 6, the lower ball valve 62 or other appropriate component is actuated when a measured parameter or parameters, e.g. pressure and/or temperature, reaches a steady-state level 102 over a predetermined period of time 104 and above a predetermined threshold 106. The processing for determining an appropriate steady-state condition occurs if the subject parameter or parameters exceed the programmed threshold values. Then, each parameter is sampled at a given frequency to achieve n number of samples in a predetermined period of time. If the measured parameter level for each successive time interval is acceptably small according to the system logic, then the steady-state condition is satisfied and actuator 96 is actuated to change the operational position of valve 62 or other controlled device. However, other methods and mechanisms can be employed to accomplish initial actuation of valve 62, such as the dissolvable ball and other methods discussed above.

Referring again to FIG. 5, another embodiment of control device 84 is designed to receive a pressure signature on the annulus, decode it, and compare it to a command library. If a match is found, control device 84 actuates a solenoid that allows hydrostatic pressure to actuate the correct valve. In the example illustrated, control device 84 comprises a transducer 86 which receives the pressure and/or temperature signal. The transducer 86 outputs the signal to a controller board 88 which processes the signals. By way of example, controller board 88 comprises a digitizer 90 which digitizes the signal for a microprocessor 92 that utilizes decoding logic 94 for determining when an appropriate signal has been sensed.

Upon sensing the predetermined signal, controller board 88 outputs an appropriate control signal to an actuator 96 which may be powered via hydrostatic pressure supplied by a hydrostatic pressure source 98. The actuator 96 actuates lower valve 62, for example, to a closed position. The controller board 88 is powered by a battery 100. It should be noted that control device 84 can be used to actuate a variety of other devices within well system 30 or within other types of downhole equipment.

Figure 7:
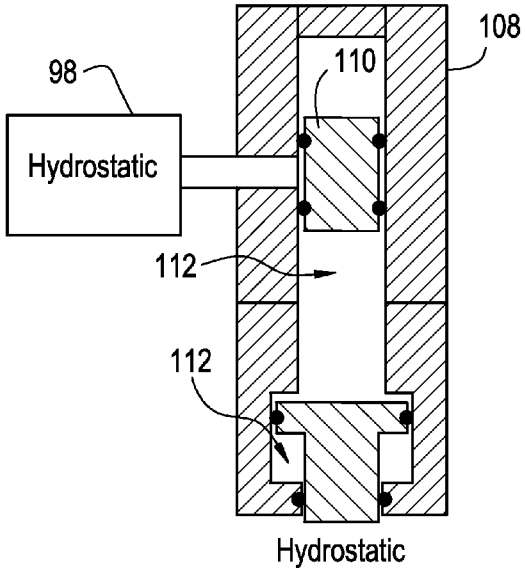
FIG. 7 is a schematic cross-sectional view of an embodiment of an actuator for use with the valve illustrated in FIG. 5, according to an embodiment of the present invention.
Figure 8:
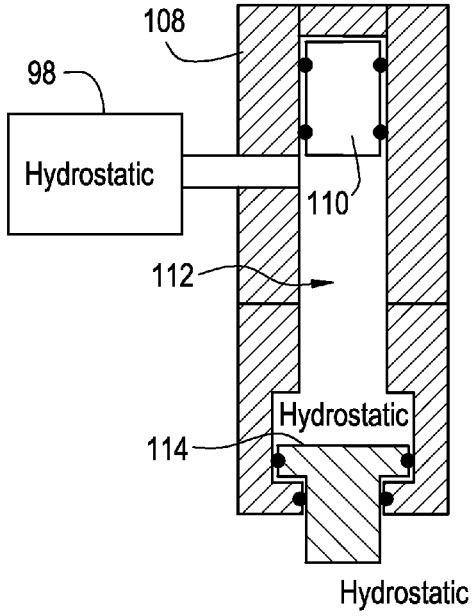
FIG. 8 is a schematic cross-sectional view of the actuator illustrated in FIG. 7 in a different operational configuration, according to an embodiment of the present invention.

By way of example, actuator 96 may comprise an electro-mechanical device 108 coupled to hydrostatic pressure source 98, as illustrated in FIG. 7. Electro-mechanical device 108 comprises a piston 110 that is selectively displaced to allow flow from hydrostatic pressure source 98 into a chamber 112 that is initially at atmospheric pressure. Piston 110 can be moved by a variety of mechanisms, such as by a solenoid or a motor powered via battery 100. As illustrated in FIG. 8, the hydrostatic pressure applied within chamber 112 enables useful work, such as the translation of a power piston 114. The translation of piston 114 is used to, for example, rotate a ball within a lower ball valve 62 or to achieve another desired actuation within a downhole component.

Figure 9:
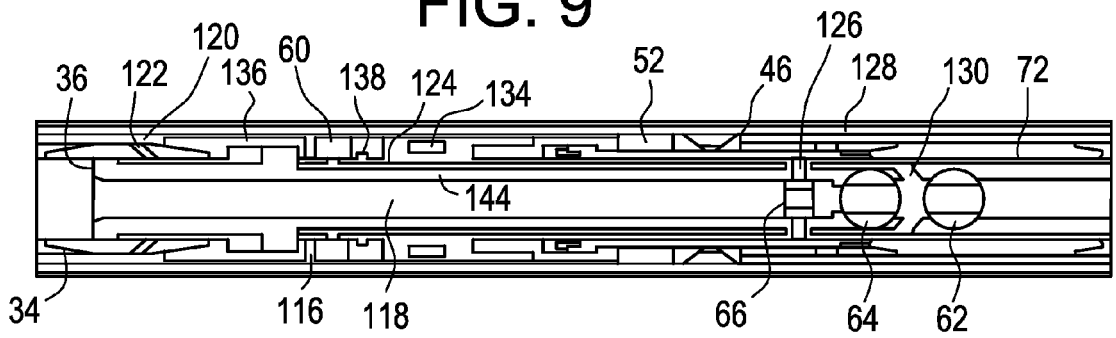
FIG. 9 is a cross-sectional view of an embodiment of a service tool, according to an embodiment of the present invention.

Referring generally to FIG. 9, one specific embodiment of service tool 36 inserted into bottom hole assembly 46 is illustrated in greater detail. In this embodiment, annular valve 60 is a sliding valve that may be moved between an open, flow position and a closed position. Annular valve 60 comprises at least one port 116 that enables flow between an internal annulus of service tool 36 and a wellbore region 120, e.g. annulus, surrounding the service tool, when valve 60 is in an open position. Accordingly, annular valve 60 enables flow between T1 and A1 (when valves 62 and 66 are closed and valve 64 is open) above GP packer 52. For reference, FIG. 9 illustrates annular valve 60 in a closed position.

In the embodiment illustrated in FIG. 9, valves 62, 64 and 66 are controlled by control module 72 which may be an IRIS based control module responsive to pressure signatures sent downhole, as described previously in this document. Each of the valves 62, 64 and 66 may be individually controlled based on unique pressure signals sent downhole through, for example, the annulus surrounding service string 34. The pressure signals are directed to control module 72 via a port 122 connected to a conduit or snorkel 124 that extends to sensor 74 of control module 72 (see also FIG. 4). In this embodiment, lower valve 62 and upper valve 64 both comprise ball valves that are movable between an open, flow position along tubing interior 118 and a closed position. However, one or both of these valves can be designed to move to selected partially closed positions, thus enabling use of such valve or valves to control the rate of fluid flow along tubing interior 118. Port body valve 66 may comprise a sliding valve selectively moved by control module 72 between an open, flow position and a closed position. In the open position, valve 66 cooperates with a flow port 126 to enable flow between the tubing interior 118 of service tool 36 and a wellbore region 128, e.g. annulus, surrounding the bottom hole assembly and service tool. For reference, FIG. 9 illustrates port body valve 66 in a closed position, and ball valves 62, 64 in open positions.

Figure 10:
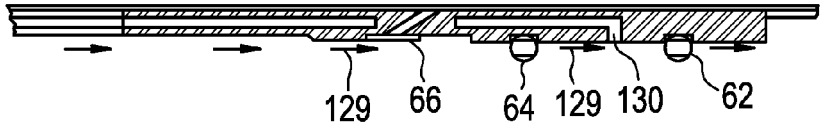
FIG. 10 is a schematic illustration demonstrating fluid flow through the service tool when the service tool is in the operational mode illustrated in FIG. 9, according to an embodiment of the present invention.

The service tool 36 and bottom hole assembly 46 illustrated in FIG. 9 can be used to carry out several different gravel packing procedures without moving service tool 36 within bottom hole assembly 46. In one embodiment of a gravel packing operation, the service string 34 is run-in-hole to the desired wellbore location. As the service string 34 is run-in-hole, the various valves are positioned as illustrated in FIG. 9. In other words, annulus valve 60 is closed, port body valve 66 is closed, upper valve 64 is open and lower valve 62 is open. As further illustrated schematically in FIG. 10, this allows the free flow of fluid along tubing interior 118, as indicated by arrows 129. In other words, the wash-down path remains open during running into wellbore 32.

Figure 11:
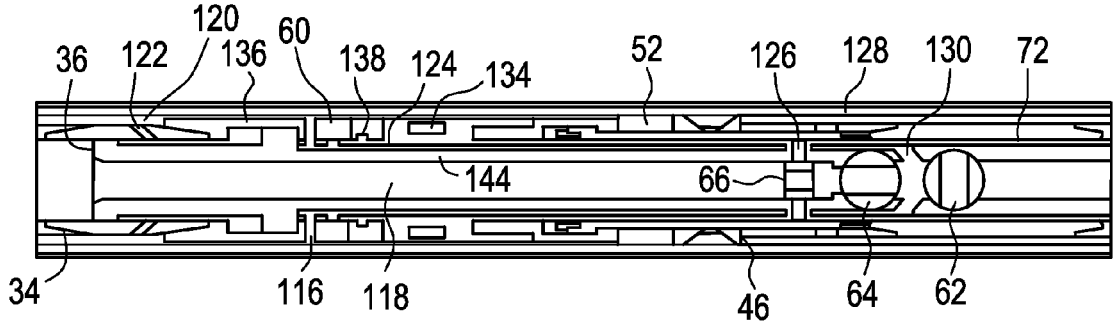
FIG. 11 is a cross-sectional view of the service tool illustrated in FIG. 9 but in a different operational mode, according to an embodiment of the present invention.
Figure 12:
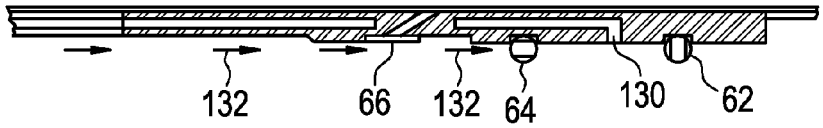
FIG. 12 is a schematic illustration demonstrating fluid flow through the service tool when the service tool is in the operational mode illustrated in FIG. 11, according to an embodiment of the present invention.

When the service tool 36 and the bottom hole assembly 46 are properly positioned within wellbore 32, lower ball valve 62 is actuated to a closed position, as illustrated in FIG. 11. The initial actuation can be achieved by a variety of methods, including use of a dedicated control device, e.g. control device 84, or use of other actuation techniques. (In one example, the lower valve 62 can be moved to the closed position to enable application of pressure in the tubing interior 118 for pressure operations upon reaching a steady-state condition with respect to pressure and/or temperature within the wellbore.) In the closed position illustrated in FIG. 11, pressure can be applied along tubing interior 118 and through an annular channel 130 to set GP packer 52. The pressure is directed as indicated by arrows 132 in FIG. 12 and then into annular channel 130. Alternatively, a pressure signature can be sent along the path indicated by arrows 132 to an appropriate trigger device 134 used to set packer 52. In one embodiment, trigger device 134 is an IRIS based trigger system designed similar to that described with respect to control module 72 so that a unique pressure signature can be detected and processed by the trigger device. The trigger device then controls a hydraulic actuator which expands and sets packer 52.

Subsequently, the wellbore annulus is pressurized to test the seal formed by GP packer 52. The service string 34 is then manipulated between pulling and slacking off weight to effectively push and pull on packer 52 which tests the ability of the packer to take weight. If the packer 52 is properly set, a slack joint portion 136 of service tool 36 is released to enable the opening and closing of annular valve 60 by movement of slack joint portion 136 relative to the stationary portion of service tool 36 within bottom hole assembly 46. The slack joint portion 136 can be released via a variety of release mechanisms. For example, a trigger device, such as trigger device 134, can be used to move a release catch 138, thereby releasing slack joint portion 136 for movement of valve 60 between open and closed positions. Other release mechanisms e.g. shear pins responsive to annulus pressure to disengage a mechanical lock and other shear mechanisms, also can be used to temporarily lock slack joint portion 136 to the remainder of service tool 36 during the initial stages of the gravel packing operation.

Figure 13:
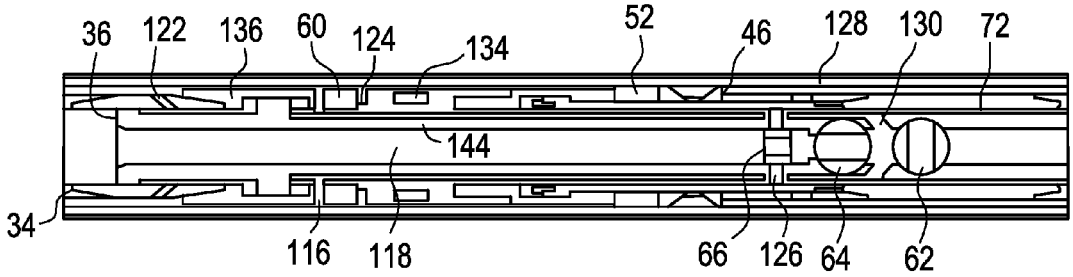
FIG. 13 is a cross-sectional view of the service tool illustrated in FIG. 9 but in a different operational mode, according to an embodiment of the present invention.
Figure 14:
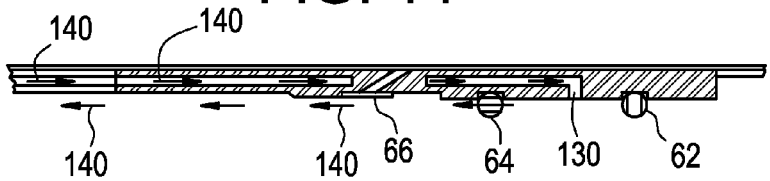
FIG. 14 is a schematic illustration demonstrating fluid flow through the service tool when the service tool is in the operational mode illustrated in FIG. 13, according to an embodiment of the present invention.

Once slack joint portion 136 is released, weight is slacked-off service string 34 to move annular valve 60 into an open position, as illustrated in FIG. 13. This position allows an operator to spot fluids through the open annular valve 60 into the surrounding annulus. This position is also known as a reverse or reverse flow position that enables a reverse flow of fluids, as indicated by arrows 140 in FIG. 14.

Figure 15:
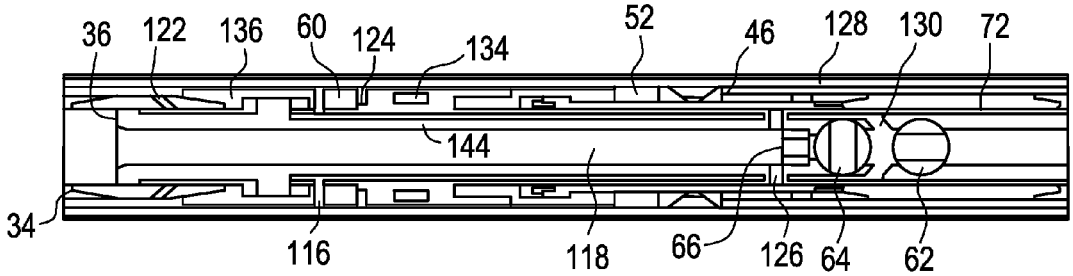
FIG. 15 is a cross-sectional view of the service tool illustrated in FIG. 9 but in a different operational mode, according to an embodiment of the present invention.
Figure 16:
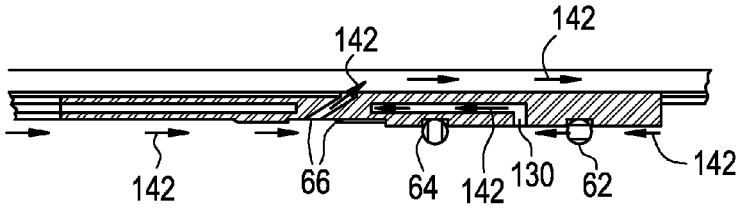
FIG. 16 is a schematic illustration demonstrating fluid flow through the service tool when the service tool is in the operational mode illustrated in FIG. 15, according to an embodiment of the present invention.

The service string 34 is then pulled up to close annular valve 60. While annular valve 60 is in the closed position, pressure signatures are sent downhole and communicated to control module 72. In response to the pressure signatures, control module 72 actuates the triple valve and moves lower valve 62 to an open position, upper valve 64 to a closed position, and port body valve 66 to an open position. The tension on service string 34 is then slacked off to again open annular valve 60, as illustrated in FIG. 15. In this configuration, gravel pack slurry is pumped down tubing interior 118 and out into the annulus through ports 126. The gravel is then deposited around screen 54, and the carrier fluid is routed upwardly through a washpipe from a lower end of bottom hole assembly 46. The carrier fluid flows upwardly through lower valve 62 around upper valve 64 via port 130 and out into the annulus through port 116 of annular valve 60. The flow path of the gravel packing operation is illustrated schematically via arrows 142 in FIG. 16. In this embodiment, the gravel slurry moves down into lower annulus 128, with clear returns moving up along an interior side of the control module.

Following development of gravel pack 56 around screen 54 (see FIG. 1), service string 34 is picked up slightly to move floating top portion 136 and again close annular valve 60. An appropriate pressure signature is then sent downhole to control module 72. Based on this pressure signature, control module 72 closes lower valve 62, opens upper valve 64, and closes port body valve 66. The pull on service string 34 is then slacked off to again open annular valve 60, which places the service tool 36 in the reverse circulation configuration illustrated in FIG. 13. In this reverse circulation configuration, fluid can be flowed down the annulus and the unused gravel packing slurry can be pushed up to the surface through tubing interior 118.

Upon completion of the reverse circulation, service string 34 is again lifted slightly to move floating top portion 136 and close annular valve 60. Then, an appropriate pressure signature is sent downhole to control module 72 which opens lower valve 62. At this time, service tool 36 also is undocked from GP packer 52 and bottom hole assembly 46 to place the service tool in the "breaker" position. In this position the service tool is configured as a pipe with a through-bore, whereby fluid can be circulated straight down to remove the filter cake accumulated along the wellbore. The service tool 36 may be released from packer 52 via a variety of release mechanisms. In one embodiment, a trigger device, such as trigger device 134, can be used to actuate a release that disengages service tool 36 from packer 52 and bottom hole assembly 46. Other release mechanisms, such as collets, hydraulically actuated latch mechanisms, mechanically actuated latch mechanisms, or other latch mechanisms, also can be used to enable engagement and disengagement of the service tool from the bottom hole assembly.

Figure 17:
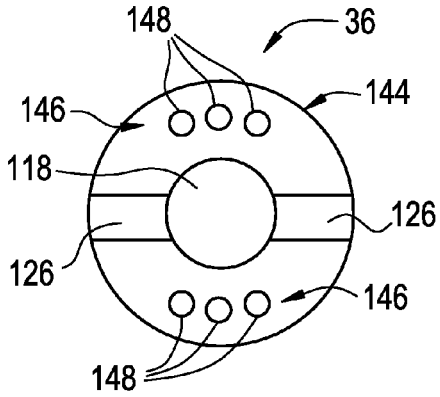
FIG. 17 is a cross-sectional view taken generally across the axis of the service tool to illustrate fluid flow passages along the service tool, according to an embodiment of the present invention.
Figure 18:
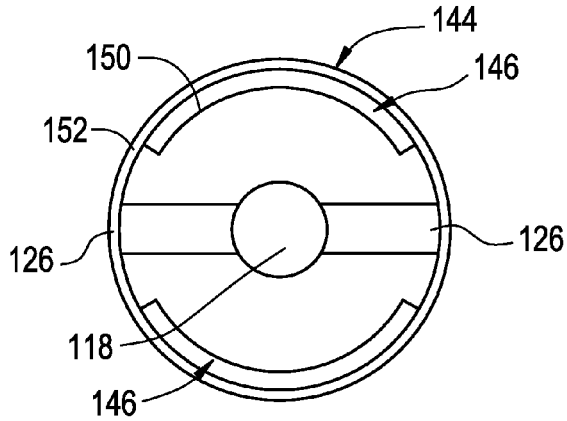
FIG. 18 is a cross-sectional view taken generally across the axis of the service tool to illustrate fluid flow passages along the service tool, according to another embodiment of the present invention.

Flow of fluid between certain ports, such as ports 130 and ports 116 can be achieved by creating flow paths along a body 144 of service tool 36. By way of example, flow paths 146 can be formed by creating a plurality of drilled bypass holes 148 extending generally longitudinally through body 144, as illustrated in the cross-sectional view of FIG. 17. Alternative types of flow paths also can be created. For example, body 144 may be formed by placing a central valve body 150 within a surrounding shroud or housing 152, as illustrated in FIG. 18. The flow paths 146 are thus created intermediate the central valve body 150 and the surrounding shroud 152.

Figure 19:
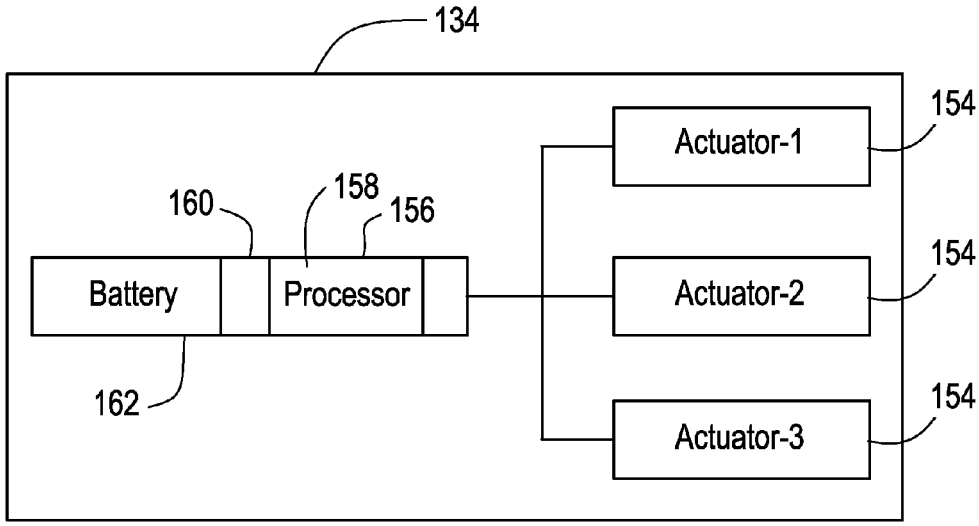
FIG. 19 is a schematic illustration of an embodiment of a trigger device that can be used to actuate components in the service string, according to an embodiment of the present invention.

As discussed above, one or more trigger devices 134 can incorporate an IRIS based control system, such as those available from Schlumberger Corporation. The one or more trigger devices 134 can be used, for example, to accomplish one-time actuation, such as the release of floating top portion 136, the release of service tool 36 from packer 52, and/or the setting of GP packer 52. Separate devices may be used for each specific action, or a single trigger device 134 can be designed with a plurality of actuators 154, as illustrated in FIG. 19. As described with respect to control module 72, each trigger device 134 controls the actuation of one or more actuators 154 upon appropriate output from trigger device electronics 156. Device electronics 156 comprises a processor 158 programmed to recognize a specific signature or signatures, such as a pressure signature received by a pressure sensor 160. The trigger device 134 also may comprise an internal battery 162 to power device electronics 156 and actuators 154. As described above with respect to control module 72 and steady-state actuation device 84, actuators 154 can be designed to utilize hydraulic pressure from the environment or from a specific hydraulic pressure source to perform the desired work.

In some applications, it may be desirable to confirm operating configurations of the service tool 36. The tracking of pressure changes in the tubing and/or the annulus can confirm specific changes in operating configuration. For example, changing the valve configuration from a reverse configuration, as illustrated in FIG. 13, to a circulate configuration, as illustrated in FIG. 15, can be confirmed by tracking pressure changes in tubing interior 118. Similarly, changing the valve configuration from a circulate configuration to a reverse configuration also can be confirmed.

In the first example, the change from a reverse configuration to a circulate configuration is confirmed by maintaining pressure in tubing interior 118. As the lower valve 62 is opened, a pressure loss is observed. At this stage, a small flow rate is maintained along tubing interior 118. When the upper valve 64 closes, pressure integrity in tubing interior 118 is observed, and pressure is maintained in tubing interior 118. When the port body valve 66 is opened, a pressure loss is again observed. The specific sequence of pressure losses and pressure integrity enables confirmation that the valve position has changed from a reverse configuration to a circulate configuration. Port 116 is closed to facilitate this observation.

In another example, the change from a circulate configuration to a reverse configuration is confirmed by providing a small flow through the annulus. When the lower valve 62 is closed, a pressure integrity in the annulus is observed. At this stage, pressure is maintained on the annulus. When the upper valve 64 is opened, a return flow is observed along tubing interior 118, and a small flow is maintained along the annulus. When the port body valve is closed, no additional losses occur through the crossover port 126. By tracking this specific sequence of events, proper change from a circulate configuration to a reverse configuration can be confirmed. Furthermore, the flow sweeps gravel from the port body valve 66, thereby increasing its operational reliability.

The specific components used in well system 30 can vary depending on the actual well application in which the system is used. Similarly, the specific component or components used in forming the service string 34 and the sandface assembly 38 can vary from one well service application to another. For example, different types and configurations of the valve actuators may be selected while maintaining the ability to shift from one valve configuration to another without moving the service tool 36 within the receptacle of the sandface assembly 38.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of performing an operation in a wellbore, comprising:

installing a permanent sandface assembly at a desired location in wellbore adjacent to a well zone;

positioning a service tool in the permanent sandface assembly;

adjusting a plurality of valves in the service tool between a first operational mode and a second operational mode without relative movement of the service tool with respect to the wellbore, wherein adjusting further comprises transitioning the service tool between circulating flow and reverse flow configurations using the plurality of valves in the service tool without moving the service tool with respect to the wellbore; and performing at least one service operation or procedure within the wellbore.

2. The method as recited in claim 1, further comprising actuating at least one valve of the plurality of valves upon sensing a steady-state condition in the wellbore.

3. The method as recited in claim 1, wherein adjusting comprises adjusting at least three valves via a control module responsive to unique control signatures sent downhole.

4. The method as recited in claim 1, wherein adjusting comprises adjusting at least three valves via a control module responsive to wireless signals sent downhole.

5. The method as recited in claim 1, wherein adjusting comprises adjusting at least three valves via a control module responsive to a pressure signature sent downhole.

6. The method as recited in claim 1, wherein adjusting comprises adjusting at least three valves via a control module responsive to pressure signals on the annulus.

7. The method as recited in claim 6, wherein actuating comprises actuating the plurality of valves between the first operational mode comprising a gravel circulation configuration and the second operational mode comprising a reverse configuration during a gravel packing operation.

8. The method as recited in claim 1, wherein adjusting comprises adjusting at least three valves via a control module responsive to load signatures on a work string coupled to the service tool.

9. The method as recited in claim 1, wherein adjusting comprises adjusting at least three valves via a control module responsive to electromagnetic signatures sent downhole.

10. The method as recited in claim 1, further comprising confirming a change in the flow configuration upon adjustment of the plurality of valves.

11. The method as recited in claim 10, wherein confirming comprises confirming via optical signals.

12. The method as recited in claim 10, wherein confirming comprises confirming via wireless signals.

13. The method as recited in claim 1, wherein adjusting comprises actuating the plurality of valves between predetermined gravel packing configurations.

14. The method as recited in claim 1, wherein confirming comprises confirming via electrical signals.

15. The method as recited in claim 1, wherein installing comprises placing a sand screen of the permanent sandface assembly at a desired location in the well zone; and wherein positioning comprises positioning the service tool above the sand screen.

16. The method as recited in claim 1, wherein adjusting comprises shifting the service tool from the circulating flow configuration to the reversing flow configuration without movement of the service tool with respect to the wellbore.

17. The method as recited in claim 16, wherein adjusting comprises shifting the service tool from the reversing flow configuration to the circulating flow configuration without movement of the service tool with respect to the wellbore.

18. A system, comprising:

a service tool to carry out a service procedure or operation adjacent to a single zone within a wellbore, the service tool comprising a plurality of valves that may be individually actuated within a separate sandface assembly without movement of the service tool with respect to the wellbore or introduction of an external object to actuate the valve, wherein the plurality of valves comprises three valves individually actuated by a control module within the service tool, the service tool further comprising a fourth valve positioned above the sandface assembly, the fourth valve being operable between an open position and a closed position, the closed position providing a pressure tight wellbore annulus that enables pressure commands through the pressure tight wellbore annulus, the open position enabling an annulus fluid flow, wherein the fourth valve is closed via tension on a service string carrying the service tool and opened with a set down load on the service string.

19. The system as recited in claim 18, wherein the control module comprises a sensor to sense a parameter signature sent downhole; and an electronics section to process the parameter signature and compare it to preprogrammed signatures corresponding with a particular valve actuation.

20. The system as recited in claim 19, wherein the parameter signature comprises a pressure signature.

21. The system as recited in claim 19, wherein the parameter signature comprises an electromagnetic signature.

22. The system as recited in claim 19, further comprising an annular valve that may be selectively opened and closed for flow-based and pressure-based procedures, respectively.

23. The system as recited in claim 22, wherein the plurality of valves may be actuated to a plurality of gravel packing configurations that enable changing the service tool between a gravel pack circulation configuration and a reverse configuration.

24. The system as recited in claim 18, further comprising a steady-state actuation device which automatically actuates at least one valve of the plurality of valves upon reaching a predetermined steady-state condition within the wellbore.

25. A system, comprising:

a service tool to carry out a service procedure or operation adjacent to a single zone within a wellbore, the service tool comprising a plurality of valves that may be individually actuated within a separate sandface assembly without movement of the service tool with respect to the wellbore or introduction of an external object to actuate the valve, wherein the plurality of valves comprises three valves individually actuated by a control module within the service tool, the service tool further comprising a fourth valve positioned above the sandface assembly, the fourth valve being operable between an open position and a closed position, the closed position providing a pressure tight wellbore annulus that enables pressure commands through the pressure tight wellbore annulus, the open position enabling an annulus fluid flow, wherein the fourth valve is closed via a set down load on a service string carrying the service tool and opened via tension on the service string.

26. A system for forming a gravel pack adjacent to a single zone in a wellbore, comprising:

a bottom hole assembly having a receptacle structure; and a service tool received in the receptacle structure, the service tool being adjustable between gravel packing modes while the service tool remains stationary within the receptacle structure, wherein the service tool is retrievable from the bottom hole assembly upon completion of a gravel packing operation, wherein the service tool comprises a plurality of valves actuated by a control module, wherein the service tool comprises an annular valve above the plurality of valves, the annular valve being selectively opened and closed by movement of a slack joint portion.

27. The system as recited in claim 26, wherein the control module is positioned between a slurry flow and a clear fluid return flow when the gravel pack is being formed.

28. The system as recited in claim 26, wherein the service tool comprises a lower tubing valve that is automatically closed after run-in of the service tool once a predetermined steady-state condition is detected in the wellbore.

29. A system, comprising:

a service tool temporarily coupled with a permanent sandface assembly located downhole, the service tool comprising a crossover system coupled with the permanent sandface assembly, the crossover system having a plurality of valves to selectively communicate or isolate various regions, the valves being actuatable to selected flow positions without relative motion of the service tool with respect to the wellbore; and a packer and wherein the various regions comprise: a tubular member above the packer (TU), an annulus above the packer (AU), a tubular member below the packer (TL), and an annulus below the packer (AL), wherein flow between the various regions is controlled by the plurality of valves located on the service tool to avoid flow control functionality on the permanent sandface assembly.

30. The service tool of claim 29 wherein the plurality of valves are configurable to allow simultaneous communication between TU and AL and between AU and TL while preventing communication between AU and AL and between TU and TL.

31. The service tool of claim 29 wherein the plurality of valves are configurable to allow communication between TU and TL while preventing communication between AU and AL.

32. The service tool of claim 29 wherein the plurality of valves are configurable to allow communication between AU and TU while preventing communication between AU and AL and between TU and TL.

33. The service tool of claim 29 wherein the plurality of valves are configurable to set the packer.

34. The service tool of claim 29 wherein the plurality of valves is configurable to pressure test the AU after the packer is set.

* * * * *